US005083431A

United States Patent [19]

Tysver

[11] Patent Number: 5,083,431

[45] Date of Patent: Jan. 28, 1992

[54] TORQUE CONTROLLED VARIABLE DISPLACEMENT HYDRAULIC MOTOR

[75] Inventor: John D. Tysver, Rockford, Ill.

[73] Assignee: Sundstrand Corporation, Rockford, Ill.

[21] Appl. No.: 394,759

[22] Filed: Aug. 16, 1989

[51] Int. Cl.[5] ..... F16D 31/02

[52] U.S. Cl. ..... 60/451; 91/504; 91/505; 91/475; 92/12.2

[58] Field of Search ..... 91/475, 504, 505; 92/12.2, 57; 60/451

[56] References Cited

U.S. PATENT DOCUMENTS

| | | | |
|---|---|---|---|
| 3,139,037 | 6/1964 | Budzich . | |
| 3,208,395 | 9/1965 | Budzich . | |
| 3,339,660 | 9/1967 | Budzich | 60/451 X |
| 4,191,094 | 3/1980 | Flippo | 91/380 X |
| 4,579,039 | 4/1986 | Ebbing | 60/451 X |
| 4,768,340 | 9/1988 | Hamilton | 60/451 X |
| 4,845,950 | 7/1989 | Metzner | 60/451 X |
| 4,858,480 | 8/1989 | Rohde et al. | 91/505 X |
| 4,907,408 | 3/1990 | Barker | 60/451 |

FOREIGN PATENT DOCUMENTS

| | | | |
|---|---|---|---|
| 3733625 | 2/1989 | Fed. Rep. of Germany | 91/504 |
| 1250703 | 8/1986 | U.S.S.R. | 91/504 |

*Primary Examiner*—Edward K. Look
*Assistant Examiner*—Todd Mattingly
*Attorney, Agent, or Firm*—Wood, Phillips, Mason, Reckentenwald & VanSanten

[57] ABSTRACT

In order to entirely eliminate pressure drop sensors in a variable displacement hydraulic motor (10), and to change the wobbler angle mechanically rather than hydraulically, the hydraulic motor (10) includes a motor housing (26) having a plurality of hydraulic cylinders (32) and a plurality of hydraulic pistons (34) radially disposed about an axis (36) thereof. A servovalve (40) is provided for controlling the rate and direction of flow of hydraulic fluid to and from the hydraulic cylinders (32), and the wobbler (22) is operatively associated with the hydraulic pistons (34) in a variably angularly positionable manner for varying displacement of the hydraulic motor (10). With this arrangement, the hydraulic motor (10) includes a cam system (22*a*, 30) for automatically varying the angular positioning of the wobbler (22) relative to the axis (36) of the hydraulic motor (10) responsive to a load-related torque at an output shaft (12) thereof.

18 Claims, 1 Drawing Sheet

TORQUE CONTROLLED VARIABLE DISPLACEMENT HYDRAULIC MOTOR

FIELD OF THE INVENTION

The present invention is directed to a hydraulic motor and, more particularly, a hydraulic motor of the variable displacement type.

BACKGROUND OF THE INVENTION

Over the years, hydraulic motors have been commonly utilized for a wide variety of commercial and industrial applications It is generally known that, depending upon the design parameters thereof, such motors are capable of developing very high torque. For certain applications, such as the leading edge flap system of aircraft, hydraulic motors are highly advantageous.

However, hydraulic motors for applications such as aircraft leading edge flap systems have typically had a fixed wobbler angle. In other words, it has been conventional for such hydraulic motors to be of the fixed displacement type primarily due to the fact that variable displacement motors must utilize expensive and complex pressure drop sensors that sense a drop in pressure across the motor and then hydraulically change the wobbler angle in order to vary displacement. In order to avoid the expense and complexity of such systems, it has been typical to rely upon a fixed displacement hydraulic motor.

Unfortunately, this means that the hydraulic motor must be designed to handle the highest load that can be expected. Thus, in the case of a leading edge flap system on an aircraft, the displacement of the motor must be quite high in order to handle any unexpected but potentially encountered high load. But this is undesirable inasmuch as there is normally a significant excess in load capacity.

As a result, the hydraulic motor requires a high rate of flow even under low load conditions which puts a substantial burden on the overall aircraft hydraulic system. For these reasons, there has again been more attention focused in recent years on utilization of variable displacement hydraulic motors.

But as previously mentioned, this has been undesirable due to the complexity, expense and reliability of known control systems for variable displacement hydraulic motors. It has generally been recognized that an electronic controller is required which functions with the sensors and hydraulic valves to hydraulically change the wobbler angle with changing load conditions. While this does achieve the objective of minimizing the burden on the aircraft hydraulic system, it is nevertheless unsatisfactory from a cost, maintenance and safety standpoint.

The present invention is directed to overcoming the above stated problems and accomplishing the stated objects.

SUMMARY OF THE INVENTION

It is the principal object of the present invention to provide a new and improved variable displacement hydraulic motor which overcomes the problems as aforementioned. More specifically, it is an object of the invention to provide a hydraulic motor in which mechanical means are provided for varying displacement in a manner automatically responsive to the load-related torque. It is likewise an object of the invention to provide a hydraulic motor utilizing a cam arrangement for automatically varying the angular positioning of the wobbler relative to the axis of the motor.

An exemplary embodiment of the invention achieves the foregoing objects in a hydraulic motor of the variable displacement type having mechanical means for varying displacement thereof. More particularly, the hydraulic motor is operable over a range of different loads, produces a load-related torque at the output shaft, and the mechanical means is automatically responsive to the load-related torque.

Preferably, the wobbler is operably associated with the hydraulic motor about an axis of the output shaft and/or hydraulic motor. The wobbler is advantageously variably angularly positionable for varying displacement of the hydraulic motor. For this purpose, the mechanical means variably angularly positions the wobbler relative to the axis responsive to the load-related torque.

In a preferred embodiment, the mechanical means includes a planetary gear system operatively associated with the output shaft. The planetary gear system may advantageously include a hydraulic motor-driven sun gear and a torque-reacting ring gear. Additionally, the planetary gear system may include a planetary gear between the sun gear and the torque-reacting ring gear.

With this construction, the output shaft may include a first portion carrying the sun gear and a second portion carrying the planetary gear. The hydraulic motor is directly operable to drive the first portion of the output shaft and the sun gear. As will be appreciated, the second portion of the output shaft may then be driven by the first portion of the output shaft through the sun gear and the planetary gear.

Other details may include the torque-reacting ring gear being integrally associated with a housing through a torsional spring. The torque-reacting ring gear will then cause the torsional spring to wind up as the load-related torque increases and will allow the torsional spring to unwind as the load-related torque decreases. To vary the angular position of the wobbler, the torque-reacting ring gear will have a cam follower operable against a cam surface on the wobbler.

When so formed, the cam follower will be in engagement with the cam surface to thereby cause the wobbler to be variably angularly positioned. This will occur, of course, responsive to the winding and unwinding of the torsional spring as the torque-reacting ring gear moves. As will be appreciated, the cam follower will move with the torque-reacting ring gear as the load-related torque increases and decreases.

In another respect, the present invention is directed to a hydraulic motor of the variable displacement type having an output shaft and a motor housing. The motor housing preferably includes a plurality of hydraulic cylinders and a plurality of hydraulic pistons radially disposed about an axis of the motor. A servovalve is preferably provided for controlling the rate and direction of flow of hydraulic fluid to and from the hydraulic cylinders of the motor and a wobbler is preferably operably associated with the hydraulic pistons in a variably angularly positionable manner for varying displacement of the motor. The wobbler angular position may again be automatically varied relative to the axis of the motor by cam means responsive to a load-related torque at the output shaft of the motor. In this connection, the wobbler may advantageously vary displacement of the hydraulic motor by varying the stroke of the hydraulic pistons.

For this purpose, the wobbler is preferably operably associated with the hydraulic pistons about the axis of the hydraulic motor. As before, the hydraulic motor will include mechanical means linking the cam means to the output shaft of the hydraulic motor, including a planetary gear system associated with the output shaft. In similar fashion, the planetary gear system will include a hydraulic motor-driven sun gear and a torque-reacting ring gear, together with a planetary gear therebetween.

Other objects, advantages and features of the present invention will become apparent from a consideration of the following specification taken in conjunction with the accompanying drawings.

DETAILED DESCRIPTION OF A PREFERRED EMBODIMENT

Figure 1:
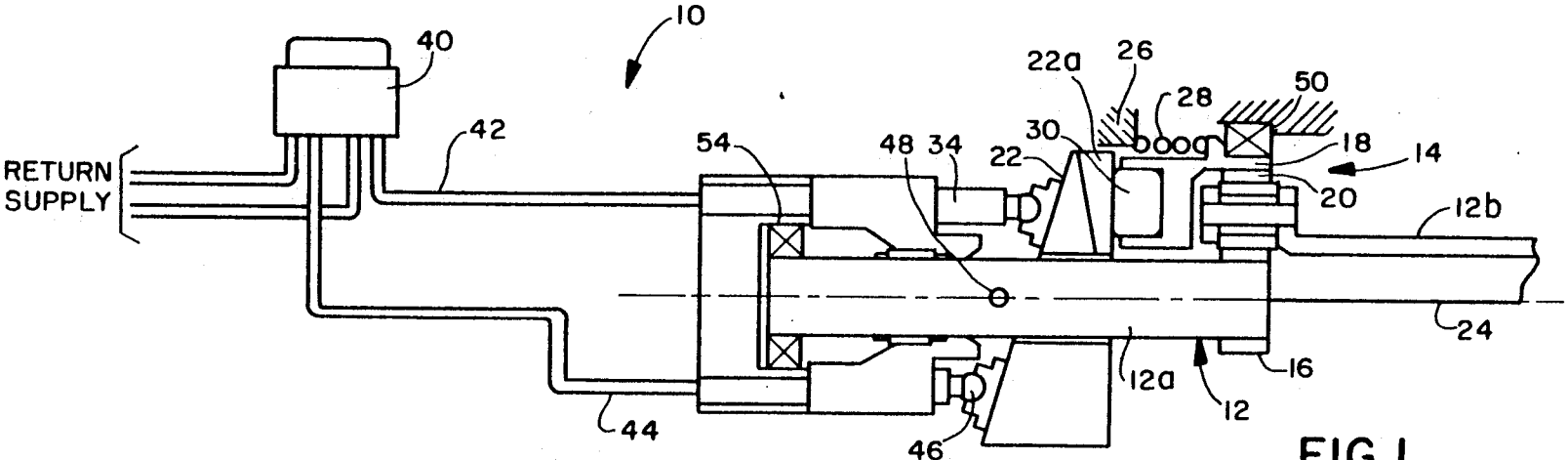
FIG. 1 is a partially schematic cross-sectional view illustrating a variable displacement hydraulic motor in accordance with the present invention.

Referring to the drawings, and first to FIG. 1, the reference numeral 10 designates generally a hydraulic motor of the variable displacement type having an output shaft generally designated 12. The hydraulic motor 10 includes mechanical means, as will be described more fully hereinafter, for varying displacement of the motor which is operable over a range of different loads and produces a load-related torque at the output shaft 12 to which the mechanical means is automatically responsive. In the preferred embodiment, the mechanical means includes a planetary gear system generally designated 14 which is operatively associated with the output shaft 12 as illustrated in FIG. 1.

In particular, the planetary gear system 14 includes a hydraulic motor-driven sun gear 16, a torque-reacting ring gear 18 and a planetary gear 20 operatively disposed therebetween.

As will be appreciated, the hydraulic motor 10 also includes a wobbler 22 operably associated therewith about an axis 24 of the output shaft 12. The wobbler is variably angularly positionable for varying displacement of the hydraulic motor 10 in a manner that will be more fully understood hereinafter. With this arrangement, the planetary gear system 14 operates to variably angularly position the wobbler 22 relative to the axis 24 responsive to the load-related torque.

More specifically, it will be noted that the output shaft 12 includes a first portion **12*a* carrying the sun gear 16 and a second portion 12*b* carrying the planetary gear 20. It will also be understood from FIG. 1 that the hydraulic motor 10 is directly operable to drive the first portion 12*a* of the output shaft 12 and the sun gear 16. With this arrangement, the second portion 12*b* of the output shaft 12 is driven through the sun gear 16 and the planetary gear 20**.

As shown, the torque-reacting ring gear 18 is integrally associated with a housing, schematically illustrated as at 26, through a torsional spring 28. The torque-reacting ring gear 18 causes the torsional spring 28 to wind up as the load-related torque increases and allows the torsional spring 28 to unwind as the load-related torque decreases. By reason of a cam follower 30 carried by the torque-reacting ring gear 18, the wobbler 22 may be variably angularly positioned mechanically without an electronic controller.

More specifically, it will be seen that the wobbler 22 includes a cam surface **22*a* in confronting relation to the cam follower 30 carried by the torque-reacting ring gear 18. The cam follower 30 is in engagement with the cam surface 22*a* (as shown in FIG. 1) to cause the wobbler 22 to be variably angularly positioned. In this connection, the cam follower 30 causes this to occur because it moves with the torque-reacting ring gear 18** as the load-related torque increases and decreases.

Referring now to both of FIGS. 1 and 2, the hydraulic motor 10 includes the motor housing 26 schematically illustrated as previously mentioned hereinabove. It will be seen from FIG. 2 that the motor housing 26 includes a cylinder block 31 which includes a plurality of hydraulic cylinders 32 having a plurality of hydraulic pistons 34 radially disposed therein about the axis 36 of the hydraulic motor 10. As will be appreciated from FIGS. 1 and 2, the axis 24 of the output shaft 12 is coincident with the axis 36 of the hydraulic motor 10 in the embodiment illustrated herein.

Referring specifically to FIG. 1, the hydraulic motor 10 includes a servovalve 40 for controlling the rate and direction of flow of hydraulic fluid to and from the hydraulic cylinders 32. The servovalve 40 is controlled by electronic control apparatus, with the hydraulic fluid being delivered to and returned from the hydraulic cylinders 32 through control lines 42 and 44. Since all of such apparatus is conventional, it has not been described in detail herein but will readily be understood by those skilled in the art of hydraulic motors.

From the foregoing, the wobbler 22 is seen to be operably associated with the hydraulic pistons 34 as by means of ball and socket connections, as at 46. These ball and socket connections 46 permit the wobbler 22 to be variably angularly positionable relative to the common axes 24 and 36 in the illustrated embodiment, whereby the displacement of the hydraulic motor 10 may be varied. In other words, the displacement of the hydraulic motor 10 may be varied by moving the wobbler 22 about the pivot point 48.

Referring to FIG. 1, the wobbler 22 varies displacement of the hydraulic motor 10 by varying the stroke of the hydraulic pistons 34 through movement of the wobbler 22 about the pivot point 48. Thus, it is possible to achieve a high displacement for high load conditions and a low displacement for low load conditions automatically and mechanically through the planetary gear system 14 and the cam means consisting of the cam surface **22*a* and the cam follower 30**. As will be appreciated, this system is self regulating, requires no electronic controller or hydraulic valves, and utilizes a simple planetary gear system to perform double duty, i.e. torque reaction for wobbler control and speed reduction.

As shown in FIG. 1, a bearing 50 will be mounted in the housing 26 to support the ring gear 18 for limited rotational movement relative thereto. Thus, the planetary gear 20 is clearly operatively disposed between the sun gear 16 and the ring gear 18, whereby load-related torque on the output shaft 12 is transmitted to the ring gear 18 (which is a torque-reacting gear) and causes movement of the ring gear 18 against the biasing force of the torsional spring 28, whereby the cam follower 30 acts against the cam surface **22*a*. As a practical matter, there will be a plurality of such planetary gears 20, although only one has been shown for purposes of avoiding clutter in of the drawings With the hydraulic motor 10, the ring gear 18 is used as a torque reaction member, i.e., when the ring gear 18 reacts a higher or lower torque, it moves radially or rotationally about the axis 24 of the output shaft 12 against or with the biasing force of the torsional spring 28, which is attached to both the housing 26 and the ring gear 18. As these movements occur, the cam follower 30 will travel along the cam surface 22***a* to force the wobbler 22 to pivot about the pivot point 48 clockwise or counterclockwise to thereby change the strokes of the hydraulic pistons 34.

Figure 2:
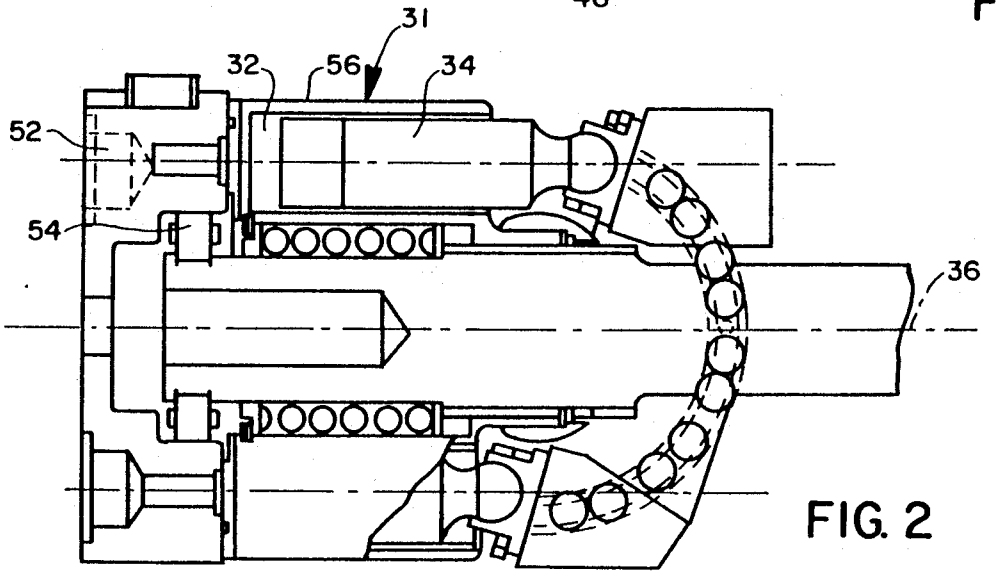
FIG. 2 is a cross-sectional view illustrating details of the pistons and cylinders of the variable displacement hydraulic motor illustrated in FIG. 1.

Referring to FIG. 2, it will be seen that various additional components have been illustrated but not discussed in any significant detail. For instance, there are hydraulic fluid ports as at 52, an output shaft bearing as at 54, cylinder walls as at 56, etc. However, since these components are not essential to the invention, and are well-known to those skilled in the art, they need not be described herein.

While in the foregoing there has been set forth a preferred embodiment of the invention, it will be appreciated that the details herein given may be varied by those skilled in the art without departing from the true spirit and scope of the appended claims.

I claim:

1. In a hydraulic motor of the variable displacement type, said hydraulic motor having an output shaft, the improvement comprising:

mechanical torque-reacting means for varying displacement of said hydraulic motor in a self-regulating manner, said hydraulic motor being operable over a range of different loads and producing a load-related torque at said output shaft and said mechanical torque-reacting means being directly and mechanically operatively associated with said output shaft, said mechanical torque-reacting means thereby being directly and automatically responsive to said load-related torque.

2. The hydraulic motor of claim 1 including a wobbler operably associated with said hydraulic motor about an axis of said output shaft, said wobbler being variably angularly positionable for varying displacement of said hydraulic motor, said mechanical torque-reacting means variably angularly positioning said wobbler relative to said axis responsive to said load-related torque.

3. In a hydraulic motor of the variable displacement type, said hydraulic motor having an output shaft, the improvement comprising:

mechanical torque-reacting means for varying displacement of said hydraulic motor in a self-regulating manner, said hydraulic motor being operable over a range of different loads and producing a load-related torque at said output shaft, said mechanical torque-reacting means being automatically and directly responsive to said load-related torque; and said mechanical torque-reacting means including a planetary gear system operatively associated with said output shaft, said planetary gear system including a hydraulic motor-driven sun gear and a torque reacting ring gear, said planetary gear system also including a planetary gear between said sun gear and said torque reacting ring gear.

4. The hydraulic motor of claim 3 wherein said output shaft includes a first portion carrying said sun gear and a second portion carrying said planetary gear, said hydraulic motor being directly operable to drive said first portion of said output shaft and said sun gear, said second portion of said output shaft being driven through said sun gear and said planetary gear.

5. The hydraulic motor of claim 4 wherein said torque reacting ring gear is integrally associated with a housing through a torsional spring, said torque reacting ring gear causing said torsional spring to wind up as said load-related torque increases, said torque reacting ring gear allowing said torsional spring to unwind as said load-related torque decreases.

6. The hydraulic motor of claim 5 wherein said wobbler includes a cam surface and said torque reacting ring gear has a cam follower, said cam follower being in engagement with said cam surface to cause said wobbler to be variably angularly positioned, said cam follower moving with said torque reacting ring gear as said load-related torque increases and decreases

7. A hydraulic motor of the variable displacement type having an output shaft, comprising:

a motor housing including a plurality of hydraulic cylinders and a plurality of hydraulic pistons radially disposed about an axis of said hydraulic motor;

a servovalve for controlling the rate and direction of flow of hydraulic fluid to and from said hydraulic cylinders of said hydraulic motor;

a wobbler operably associated with said hydraulic pistons in a variably angularly positionable manner for varying displacement of said hydraulic motor, said wobbler being operably associated with said hydraulic pistons about said axis of said hydraulic motor, said wobbler varying displacement of said hydraulic motor by varying the stroke of said hydraulic pistons; and mechanical torque-reacting means including cam means for automatically varying the angular positioning of said wobbler relative to said axis of said hydraulic motor responsive to a load-related torque at said output shaft of said hydraulic motor, said mechanical torque-reacting means including gear means linking said cam means to said output shaft of said hydraulic motor.

8. The hydraulic motor of claim 7 wherein said gear means includes a planetary gear system operatively associated with said output shaft, said planetary gear system including a hydraulic motor-driven sun gear and a torque reacting ring gear, said planetary gear system also including a planetary gear between said sun gear and said torque reacting ring gear.

9. The hydraulic motor of claim 8 wherein said output shaft includes a first portion carrying said sun gear and a second portion carrying said planetary gear, said hydraulic motor being directly operable to drive said first portion of said output shaft and said sun gear, said second portion of said output shaft being driven through said sun gear and said planetary gear.

10. The hydraulic motor of claim 9 wherein said torque reacting ring gear is integrally associated with said housing through a torsional spring, said torque reacting ring gear causing said torsional spring to wind up as said load-related torque increases, said torque reacting ring gear allowing said torsional spring to unwind as said load-related torque decreases.

11. The hydraulic motor of claim 10 wherein said cam means includes a cam surface on said wobbler and a cam follower on said torque reacting ring gear, said cam follower being in engagement with said cam surface to cause said wobbler to be variably angularly positioned, said cam follower moving with said torque reacting ring gear as said load-related torque increases and decreases.

12. In a hydraulic motor of the variable displacement type having an output shaft, a motor housing including a plurality of hydraulic cylinders and a plurality of hydraulic pistons radially disposed about an axis of said hydraulic motor; and a servovalve for controlling the rate and direction of flow of hydraulic fluid to and from said hydraulic cylinders of said hydraulic motor, the improvement comprising:

a wobbler operably associated with said hydraulic pistons in an automatic mechanically variable and angularly positionable manner for varying displacement of said hydraulic motor; and cam means operably associated with said wobbler and said output shaft of said hydraulic motor, said cam means automatically varying the angular positioning of said wobbler relative to said axis of said hydraulic motor, said cam means being responsive to a load-related torque at said output shaft of said hydraulic motor;

said cam means including a cam surface and a cam follower, said cam means being responsive to said load-related torque at said output shaft through gear means, said gear means including a torque reacting gear operably associated with one of said cam surface and said cam follower.

13. The hydraulic motor of claim 12 wherein said torque reacting gear includes a ring gear integrally associated with said housing through a torsional spring, said torque reacting ring gear causing said torsional spring to wind up as said load-related torque increases, said torque reacting ring gear allowing said torsional spring to unwind as said load-related torque decreases.

14. The hydraulic motor of claim 12 wherein said wobbler is operably associated with said hydraulic pistons about said axis of said hydraulic motor, said wobbler varying displacement of said hydraulic motor by varying the stroke of said hydraulic pistons, said gear means linking said cam means to said output shaft of said hydraulic motor.

15. The hydraulic motor of claim 14 wherein said gear means includes a planetary gear system operatively associated with said output shaft, said planetary gear system including a hydraulic motor-driven sun gear and a torque reacting ring gear, said planetary gear system also including a planetary gear between said sun gear and said torque reacting ring gear.

16. The hydraulic motor of claim 15 wherein said output shaft includes a first portion carrying said sun gear and a second portion carrying said planetary gear, said hydraulic motor being directly operable to drive said first portion of said output shaft and said sun gear, said second portion of said output shaft being driven through said sun gear and said planetary gear.

17. The hydraulic motor of claim 16 wherein said torque reacting ring gear is integrally associated with a housing through a torsional spring, said torque reacting ring gear causing said torsional spring to wind up as said load-related torque increases, said torque reacting ring gear allowing said torsional spring to unwind as said load-related torque decreases.

18. The hydraulic motor of claim 17 wherein said cam surface is on said wobbler and said cam follower is on said torque reacting ring gear, said cam follower being in engagement with said cam surface to cause said wobbler to be variably angularly positioned, said cam follower moving with said torque reacting ring gear as said load-related torque increases and decreases.

* * * * *